US008424649B2

(12) United States Patent
Mehloch et al.

(10) Patent No.: US 8,424,649 B2
(45) Date of Patent: Apr. 23, 2013

(54) BEARING ASSEMBLY FOR LIFT CHAIN ROLLERS IN A MULTIPLE LIFT MAST FOR HIGH-LIFT FORK TRUCKS

(75) Inventors: Piotr Mehloch, Hamburg (DE); Bernhard Meussen, Elmshorn (DE); Walter Rahlmann, Itrzstedt (DE)

(73) Assignee: Jungheinrich Aktiengesellschaft, Hamburg (DE)

( * ) Notice: Subject to any disclaimer, the term of this patent is extended or adjusted under 35 U.S.C. 154(b) by 683 days.

(21) Appl. No.: 12/029,000

(22) Filed: Feb. 11, 2008

(65) Prior Publication Data

US 2008/0217109 A1 Sep. 11, 2008

(30) Foreign Application Priority Data

Mar. 8, 2007 (DE) ..... 20 2007 003 491 U

(51) Int. Cl.
*B66F 9/08* (2006.01)
*B66F 9/22* (2006.01)

(52) U.S. Cl.
USPC ..... 187/230; 187/226; 187/234; 187/238; 414/631; 414/414

(58) Field of Classification Search ..... 187/226, 187/227, 236, 234, 233, 238; 414/631, 279, 414/918; *B66F 9/08*
See application file for complete search history.

(56) References Cited

U.S. PATENT DOCUMENTS

| | | | |
|---|---|---|---|
| 3,127,956 | A | 4/1964 | Hosbein |
| 3,160,232 | A | 12/1964 | Coawell Savage |
| 3,394,778 | A | 7/1968 | Brinton |
| 3,727,778 | A | 4/1973 | Hollenbach |
| 4,030,568 | A | 6/1977 | Heinhold |
| 4,191,276 | A | 3/1980 | Farmer |
| 4,238,004 | A | 12/1980 | Olson |
| 4,261,438 | A | 4/1981 | Olson |
| 4,355,703 | A | 10/1982 | Bartow |
| 4,356,891 | A | 11/1982 | Bartow |
| 4,356,893 | A | 11/1982 | Johannson |
| 4,365,693 | A | 12/1982 | McVeen |
| 4,369,861 | A | 1/1983 | Rietman |

(Continued)

FOREIGN PATENT DOCUMENTS

EP 1 505 033 A1 8/2004

OTHER PUBLICATIONS

Document submitted to Raymond, Assignee of Pat. No. 7,096,999 as possible prior art.

*Primary Examiner* — Michael Mansen
*Assistant Examiner* — Stefan Kruer
(74) *Attorney, Agent, or Firm* — Vidas, Arrett & Steinkraus, P.A.

(57) ABSTRACT

A bearing assembly for lift chain rollers in a multiple lift mast for high-lift fork trucks which mast has a fixed mast, a middle mast, and an inner telescoping mast, each of which has two parallel-distanced mast profiles, wherein at an upper end of each the mast profiles of the middle mast, a lift chain roller is mounted for each of at least one lift chain for lifting the inner mast, wherein the lift chain roller is disposed in front of the inner mast crosswise to a web of the middle mast profile, wherein a separate bearing component for the lift chain roller is placed onto the mast profile or onto a cross-beam joining the tops of the mast profiles from top, and welded thereto.

9 Claims, 4 Drawing Sheets

U.S. PATENT DOCUMENTS

| | | | | | |
|---|---|---|---|---|---|
| 4,374,550 | A | | 2/1983 | Bartow | |
| 4,392,554 | A | | 7/1983 | Russey | |
| 4,441,585 | A | | 4/1984 | Macnab | |
| 4,506,764 | A | | 3/1985 | Griesenbrock et al. | |
| 4,585,093 | A | | 4/1986 | Barda, Jr. | |
| 4,657,471 | A | * | 4/1987 | Shinoda et al. | 414/663 |
| 4,721,187 | A | | 1/1988 | Riddle | |
| 5,000,293 | A | * | 3/1991 | Brown et al. | 187/227 |
| 5,046,585 | A | | 9/1991 | Ohta et al. | |
| 5,330,032 | A | | 7/1994 | Warner | |
| 5,370,206 | A | | 12/1994 | Chao | |
| 5,509,774 | A | | 4/1996 | Yoo | |
| 5,984,050 | A | | 11/1999 | Ronald | |
| 5,992,571 | A | | 11/1999 | Lee | |
| 6,182,797 | B1 | | 2/2001 | Tebbe et al. | |
| 6,505,710 | B1 | | 1/2003 | Kato | |
| 6,564,906 | B1 | | 5/2003 | Haack et al. | |
| 7,096,999 | B2 | | 8/2006 | Lewis et al. | |
| 2007/0007081 | A1 | | 1/2007 | Lewis | |

* cited by examiner

BEARING ASSEMBLY FOR LIFT CHAIN ROLLERS IN A MULTIPLE LIFT MAST FOR HIGH-LIFT FORK TRUCKS

CROSS-REFERENCE TO RELATED APPLICATIONS

Not applicable.

STATEMENT REGARDING FEDERALLY SPONSORED RESEARCH

Not applicable.

BACKGROUND OF THE INVENTION

A multiple lift mast is composed of at least one fixed mast and an extendable mast, each mast having two distanced mast profiles which are joined via cross-beams at the lower and upper ends. Two telescoping mast length portions are provided if the multiple lift masts are extendable to a large height. The length portions are moved apart by a sophisticated lifting device. This includes that the middle lift mast, at the upper end, mounts a lift chain roller which is passed over one lift chain which engages the inner mast at one end in order to extend the inner mast as well when the middle mast is being shifted. The other end of the chain is caused to rest on the fixed mast. It is known to design the mast profiles as U-profiles or even as I-profiles.

Further, it is known to guide the telescoping masts by means of suitable guide rollers in order to produce a minimal friction during extension and retraction.

A telescoping mast having the above characteristics has been known from EP 1 505 033 A1, the entire contents of which is incorporated herein by reference, for example. This state of the art has also made it known to provide the sense of rotation of lift chain rollers crosswise to the direction of travel and position the rollers between the front-end flanges of the middle and inner masts to be extended. To enable roller assembly, pockets in which the rollers run are cut into the web of the I-section profile. The effort in manufacturing them is relatively large. Moreover, this will weaken the profile geometry.

It is the object of the invention to provide a bearing assembly for lift chain rollers in a multiple lift mast for high-lift fork trucks that does not present the drawbacks mentioned and allows mounting the lift chain rollers in a simple way without weakening the mast cross-section in an unnecessary way.

BRIEF SUMMARY OF THE INVENTION

In the inventive bearing assembly, a separate bearing component for the lift chain roller is placed onto the mast profile from top and is welded thereto. According to an aspect of the invention, the bearing profile preferably is of a U-shape, which has downwardly facing leg ends welded to the mast profile. As all alternative, the bearing component may be formed by a rectangular frame which is welded on top of the mast profile.

Mounting a prefabricated, separate bearing component on an I-shaped mast profile proves to be relatively unproblematic even if it is necessary to partially remove an inner flange of the mast profile. It is particularly beneficial to mount a separate bearing component on a mast profile which is configured as an I-shape with an attached T-shape. Two flanges are located relatively close to each other at the inside of the mast profile and, hence, enable a stable support for the bearing component without any consequence that if flange portions are removed the mast structure will be appreciably weakened near the bearing component at the inside of the mast profile.

According to an aspect of the invention, the bearing component is defined by a footing of a cross-beam via which the cross-beam is attached by welding to the mast profile. The cross-beam, which is designed in a horizontal U-shape in most cases, can get its legs welded flat onto the upper end of the mast profile. However, the legs of the U-shaped cross-beam can also be provided with downwardly facing footings, via which they are joined to the mast profiles. If the footings are fitted with an appropriate bearing recess they are able to receive the roller.

According to an aspect of the invention, the footing can have welded thereto a journal pin for a guide roller for the mast profiles of the inner mast.

According to an aspect of the invention, a provision is made for the cross-beam to have a recess which accommodates a block-shaped adapter part which is fixed by welding to the mast profile next to the bearing component, wherein the cross-beam, in turn, is joined to the block-shaped adapter part by being welded. The block-shaped adapter part may be equipped with a journal pin for a guide roller.

According to an aspect of the invention, the mast profile may be provided, at the upper end, with a cut-out into which the bearing component is inserted rather than placing the bearing profile onto the mast profile from top, which possibly will increase the overall height of a mast in an unnecessary way.

BRIEF DESCRIPTION OF THE SEVERAL VIEWS OF THE DRAWINGS

The upper end of the bearing component may be disposed slightly higher or lower or even at the same level as the cross-beam.

Embodiments of the invention will be described below with reference to drawings.

DETAILED DESCRIPTION OF THE INVENTION

Figure 1:
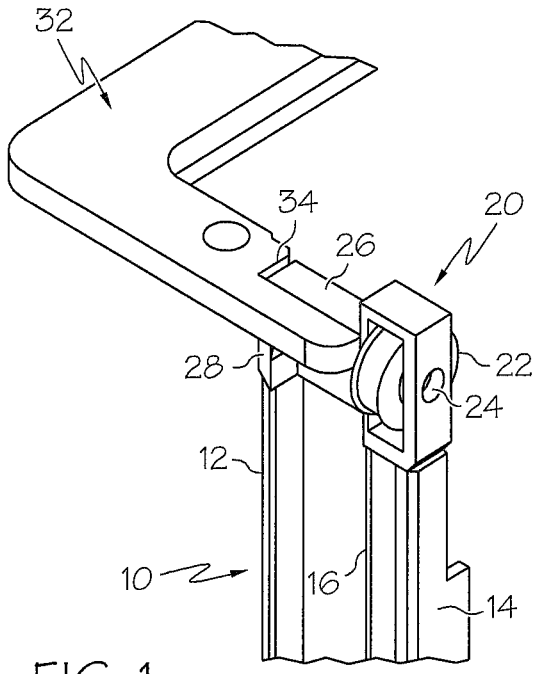
FIG. 1 shows a first embodiment of a bearing assembly for a lift chain roller according to the invention from the outside in a perspective view.
Figure 2:
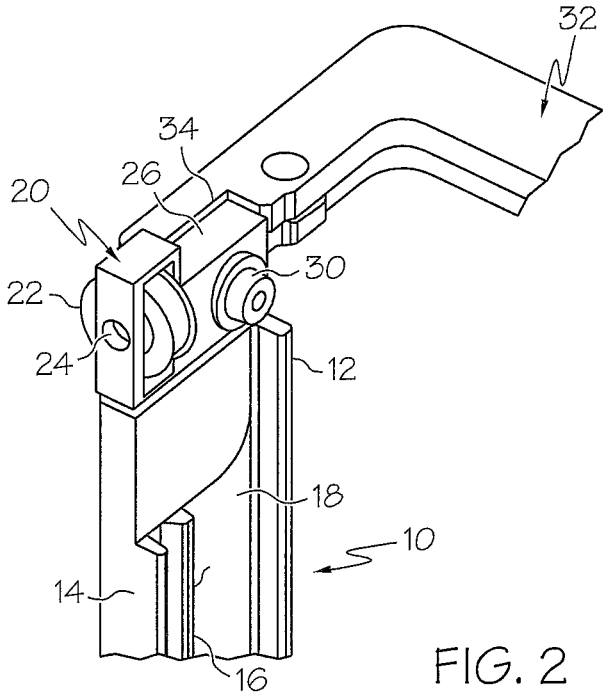
FIG. 2 shows the representation of FIG. 1 from the inside in a perspective view.
Figure 3:
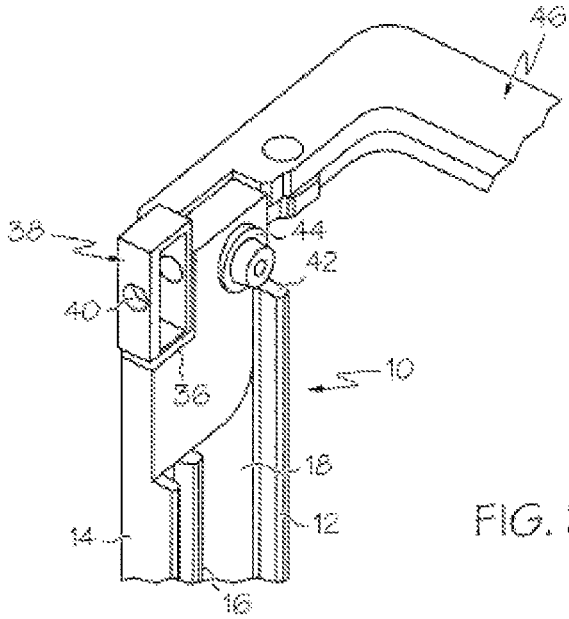
FIG. 3 shows another embodiment of a bearing assembly for a lift chain roller according to the invention.
Figure 4:
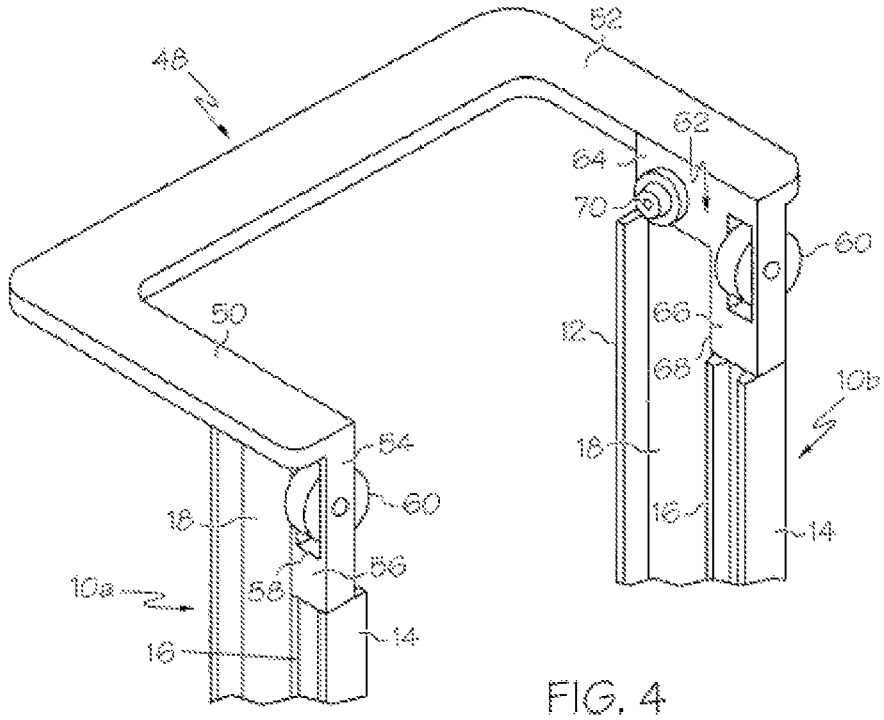
FIG. 4 shows a representation of two further embodiments of a bearing assembly for lift chain rollers according to the invention.

While this invention may be embodied in many different forms, there are described in detail herein a specific preferred embodiment of the invention. This description is an exemplification of the principles of the invention and is not intended to limit the invention to the particular embodiment illustrated The description of the embodiments proceeds on the assumption that a triply telescoping lift frame for a high-lift fork truck, which is not shown, is provided and has a fixed mast, a middle mast, and an inner mast as is known from EP 1 505 033 A1, for example. Also known is the mechanism for extending and retracting the masts where each mast has two distanced mast profiles which are joined to each other by an upper and a lower cross-beam. In FIGS. 1 to 3, only one mast profile each of a middle mast is illustrated with the upper cross-beam outlined. In FIG. 4, the two mast profiles of a middle mast are shown with the upper cross-beam.

A mast profile 10 of a middle mast for the multiple lift mast assembly described is an I-shape in cross-section, to which a T-profile in cross-section is attached. The rear flange is indicated by 12, the front-end flange by 14, and the middle flange by 16. Here, the middle flange 16 is located relatively close to the front-end flange (if the speech is about "front" and "rear" above and below this refers to the direction of forward travel and the position of the load-carrying means of an industrial truck that is equipped with the lift frame). An industrial truck of this type is a fork-lift reach truck, for example.

As is seen from FIG. 2, the flanges 14, 16 have been removed at the inside from below the upper end up to the web 18 of the mast profile 10. Placed onto the mast profile 10 is a rectangular steel frame 20, namely near the front end of the upper end in alignment with the outside of the front-end flange 14. The frame 20 the width of which is approximately half the length of the flange 14 and 16, respectively, serves as a bearing component for a lift chain roller 22. The journal pin which is passed through holes 24 of the frame 20 and serves for supporting the roller 22 is not shown. Nor is the lift chain shown which is passed over the roller 22 for telescoping purposes.

The width of the bearing component 20 approximately matches a distance between flanges 14 and 16.

Next to the bearing component 20, a block-shaped adapter part 26 is placed onto the remainder of the upper surface and the upper end of the mast profile 10 and is welded thereto. Both the steel frame and block 26 may be of one piece. As can be recognized from FIG. 1 the adapter part 26 has an outwardly facing portion 28 which is aligned with the rear flange 12 and is supported thereon. Welded to the inside of the block-shaped adapter part 26 is a journal pin 30 for a guide roller, not shown, for guiding the inner mast in the middle mast.

FIGS. 1 and 2 also show a cross-beam 32 which joins the two mast profiles to each other at the upper end. It is U-shaped and located horizontally. Its legs are recessed at the end at 34 so that the adapter part 26 and is received so as to fit approximately. The legs are welded to the outside of the block-shaped adapter part 26.

In the embodiment of FIG. 3, the mast profile 10 equals the mast profile 10 of FIGS. 1 and 2. In contrast to that of FIGS. 1 and 2, however, the mast profile 10 is provided with a cut-out 36 at the front side. The cut-out has fittingly inserted therein an inversely U-shaped bearing component 38, which is welded to the leg ends at the bottom of the cut-out 36 and the rear leg against the respective wall of the cut-out 36. The legs of the U-shaped bearing component 38 have apertures 40 for the accommodation of a journal pin to support the lift chain roller, which is not shown.

As can further be appreciated from FIG. 3 the flange 12 also has partially been removed at the upper end at the inside as is shown at 42. This has created a space for welding on a journal pin 44 for a guide roller, which is not shown.

A U-shaped cross-beam 46 similar to the cross-beam 32 of FIGS. 1 and 2 has its legs welded to the outside of the mast profile 10, whereby the flanges 12 and 14 can be removed in the area of the legs at the outside of the mast profile 10.

In the embodiments of FIGS. 1 to 3, the bearing components 20 and 38 each extend slightly above the cross-beams 32 and 46, respectively. If the cut-out 36 of FIG. 3 is dimensioned appropriately it also is possible to naturally position the bearing component 38 so low that it either has its upper side flush with the cross-beam 46 or is even located below the cross-beam 46.

In the embodiment of FIG. 4, the two mast profiles 10*a* and 10*b* of a middle telescoping mast are outlined for the described lift frame. The cross-sectional profile equals that of FIGS. 1 to 3 so that portions of the flange are provided with the same reference numbers.

A cross-beam joining the mast profiles 10*a* and 10*b* at the upper end is designated 48 and is horizontally U-shaped having legs 50, 52. At its free end, the leg 50 has a downwardly extending footing 54 which is received by a recess 56 at the upper end of the mast profile 10*a*. The recess is formed partially in the web 18 and partially in the area of the front-end flanges 14, 16 as can be seen from FIG. 4. The lower end of the footing 54 is supported on the bottom of the recess and is fixed thereto by welding. It is also fixed by welding against the web 18 of the mast profile 10*a*. The footing 54 has a pocket 58 in which a lift chain roller 60 is rotatably mounted.

A footing 62 of the leg 52 is configured angularly with an upper leg 64 resting on an upper end portion of the mast profile 10*b* whereas the other vertical leg 66 is received by an appropriate recess 68 of the mast profile 10*b*. Here, the leg 66 is supported on the flanges 14, 16 and the web portion which is located therebetween. Again, fixing is done by welding. Moreover, the insides of the legs 64, 66 are fixed by welding, i.e. welding to the associated abutting surfaces of the upper end of the mast profile 10*b*. At the inside, the leg 64 also has a journal pin 70 fixed by welding for a guide roller. The footings may be separate parts which are joined to the cross-beam by welding.

Figure 5:
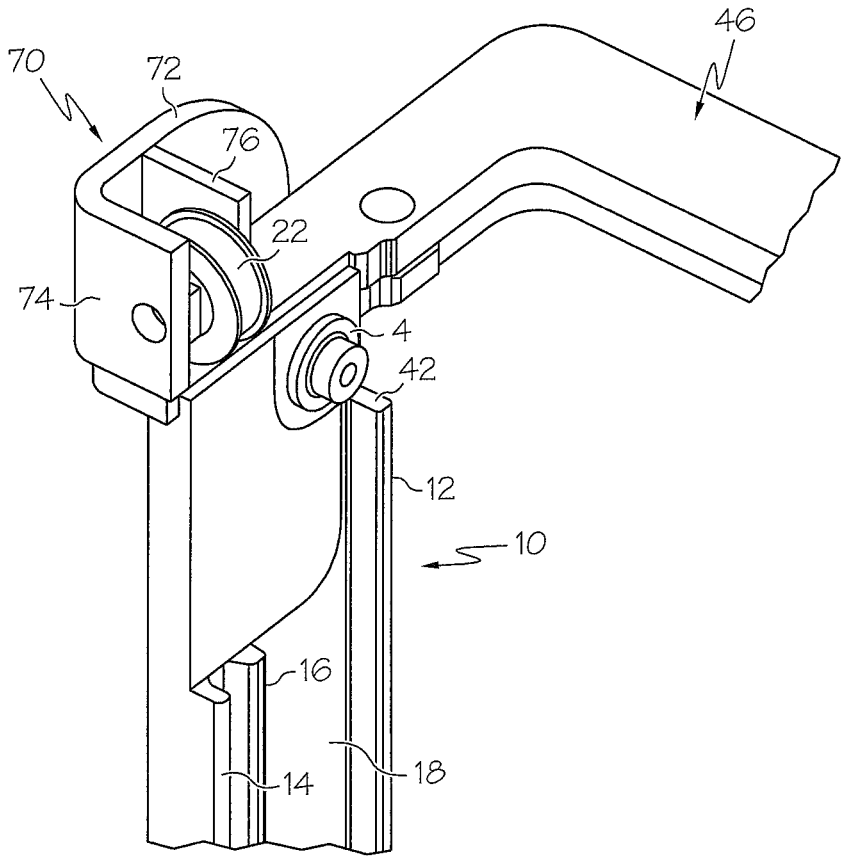
FIG. 5 shows a further embodiment of the bearing assembly according to the invention.
Figure 6:
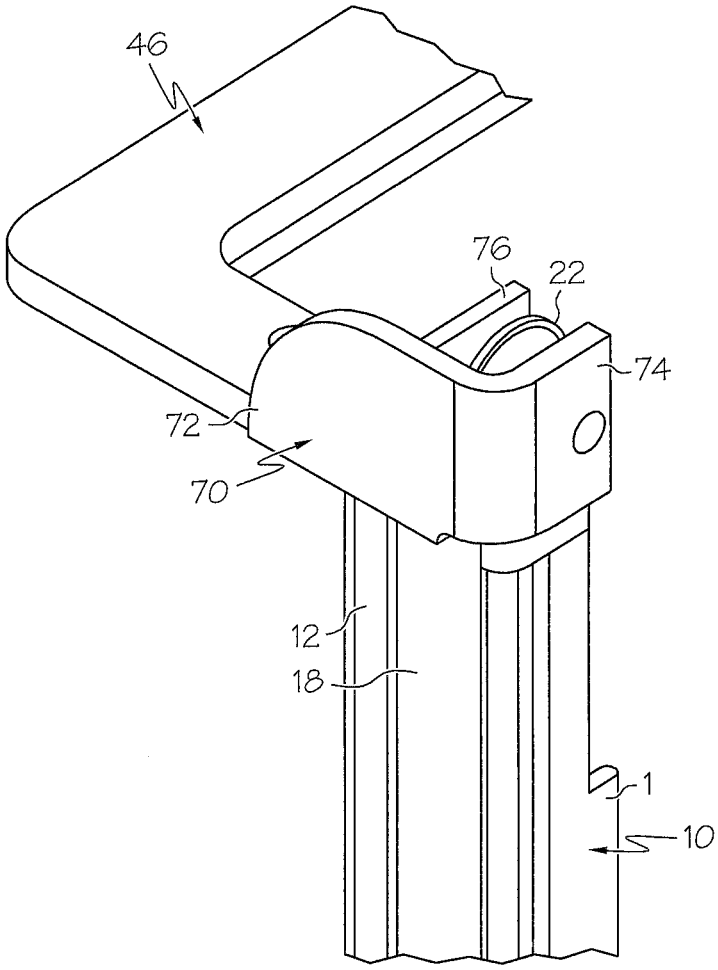
FIG. 6 shows the representation of FIG. 5 in an external view.

The embodiment of FIGS. 5 and 6 partially equals that of FIG. 3 so that like parts are given like reference numbers. The legs of the U-shaped cross-beam 46 come to bear against the mast profile 10 of the middle mast from the outside. An angle-shaped component part 70 has a first leg 72 borne on the outside of the associated leg of the U-shaped cross-beam 46 and a second leg 74 against the end of the cross-beam leg. The angular component part 70 has its legs substantially positioned vertically. Perpendicularly arranged with respect to the leg 72 is a bearing plate 76 which is welded to the leg 72 and onto the upper side of the leg of the cross-beam 46. Both the bearing plate 75 and leg 74 are disposed parallel at a spacing from each other and define a bearing component for the roller chain 22. The journal pin belonging thereto is not illustrated.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A bearing assembly for lift chain rollers in a multiple lift mast for high-lift fork trucks, said multiple lift mast having a front end at the forward travel direction of the truck and a rear end at the rearward travel direction of the truck, said multiple lift mast comprising a fixed mast, a middle mast, and an inner telescoping mast each of which has two parallel-distanced mast profiles, wherein at an upper end of each of the two parallel-distanced mast profiles of the middle mast, a lift chain roller is mounted for each of at least one lift chain, each of said lift chain to lift the inner mast, wherein the lift chain roller is disposed in front of the inner mast, towards the front end of the truck, and crosswise to a web of the middle mast profile characterized in that a separate bearing component (20, 38) for the lift chain roller (22, 60) is placed onto each of the mast profiles (10, 10*a*, 10*b*) or onto a cross-beam joining the mast profiles from top, and is welded thereto, wherein the bearing component (48) is defined by a footing (54, 66) of the cross-beam via which the cross-beam is attached by welding to the mast profiles (10*a*, 10*b*) of the middle mast, and further wherein the footing (66, 64) has disposed thereon a journal pin (70) for a guide roller.

2. The bearing assembly according to claim 1, characterized in that the bearing component (38) is of a U-shape, which has downwardly facing leg ends welded to the mast profile.

3. The bearing assembly according to claim 1, characterized in that the bearing component (20) has a rectangular frame which is welded on top of the mast profile (10).

4. The bearing assembly according to claim 1, characterized in that the cross-beam (32) has a recess (34) in its legs that accommodates a block-shaped adapter part (26) which is welded to the mast profile (10) adjacent to the bearing component (20), wherein the block-shaped adapter part (26) is welded to the leg of cross-beam (32).

5. The bearing assembly according to claim 1, characterized in that at an upper end of the mast profile (10), on a side facing away from the cross-beam (46), the mast profile has a cut-out (36) that receives the bearing component.

6. The bearing assembly according to any claim 1, characterized in that the upper end of the bearing component is disposed slightly higher than the cross-beam, approximately at the level of the cross-beam or slightly below the cross-beam.

7. The bearing assembly according to claim 1, characterized in that two flanges, which are disposed at the inside of the mast profile of the middle mast, are a predetermined distance below the bearing component.

8. The bearing assembly according to claim 1, characterized in that a web portion of the mast profile has a journal pin (44) for a guide roller, wherein the bearing component (20, 38) has a journal pin for a lift chain roller (22).

9. The bearing assembly according to claim 1, characterized in that the middle mast has an I-profile with an attached T-profile.

* * * * *